US008210867B2

(12) United States Patent
Kojima

(10) Patent No.: US 8,210,867 B2
(45) Date of Patent: Jul. 3, 2012

(54) CONNECTION STRUCTURE OF COAXIAL HARNESS

(75) Inventor: Shigeru Kojima, Sakura (JP)

(73) Assignee: Fujikura Ltd., Tokyo (JP)

( * ) Notice: Subject to any disclaimer, the term of this patent is extended or adjusted under 35 U.S.C. 154(b) by 0 days.

(21) Appl. No.: 13/161,104

(22) Filed: Jun. 15, 2011

(65) Prior Publication Data

US 2011/0244723 A1 Oct. 6, 2011

Related U.S. Application Data

(63) Continuation of application No. PCT/JP2009/006798, filed on Dec. 11, 2009.

(30) Foreign Application Priority Data

Dec. 16, 2008 (JP) ..... 2008-319916

(51) Int. Cl.
*H01R 12/24* (2006.01)

(52) U.S. Cl. ..... 439/497; 439/83; 439/498

(58) Field of Classification Search ..... 439/492–499, 439/579, 83
See application file for complete search history.

(56) References Cited

U.S. PATENT DOCUMENTS

| | | | | |
|---|---|---|---|---|
| 4,831,456 | A * | 5/1989 | Takamura | 348/374 |
| 2004/0175982 | A1* | 9/2004 | Kuroda et al. | 439/358 |
| 2006/0067066 | A1* | 3/2006 | Meier et al. | 361/785 |
| 2008/0139046 | A1 | 6/2008 | Semba et al. | |
| 2008/0235945 | A1 | 10/2008 | Nakamae | |
| 2010/0243293 | A1* | 9/2010 | Tanaka | 174/117 F |

FOREIGN PATENT DOCUMENTS

| | | | |
|---|---|---|---|
| JP | 10-032052 | A | 2/1998 |
| JP | 2005-310527 | A | 11/2005 |
| JP | 2007-287541 | A | 11/2007 |
| JP | 2008-218389 | A | 9/2008 |
| JP | 2008-270108 | A | 11/2008 |
| JP | 2008-270202 | A | 11/2008 |

* cited by examiner

*Primary Examiner* — Renee Luebke
*Assistant Examiner* — Larisa Tsukerman
(74) *Attorney, Agent, or Firm* — Sughrue Mion, PLLC

(57) ABSTRACT

A connection structure of a coaxial harness includes a coaxial harness, a ground bar, and a substrate. The coaxial harness includes a plurality of coaxial cables lined up. The coaxial cable includes a center conductor, an inner insulator, an outer conductor, and a jacket. The inner insulator and the outer conductor and the jacket are placed at an outer side of the center conductor in an order of the inner insulator, the outer conductor, and the jacket. The ground bar sandwiches a plurality of the outer conductor exposed at an end terminal part of the coaxial harness. The substrate is provided with a ground bar connection terminal and a center conductor connection terminal group. The ground bar connection terminal is connected with the ground bar. The center conductor connection terminal group includes an alignment of a center conductor connection terminal connected respectively to the center conductor.

9 Claims, 5 Drawing Sheets

CONNECTION STRUCTURE OF COAXIAL HARNESS

CROSS REFERENCE TO RELATED APPLICATIONS

This application is a continuation application based on a PCT Patent Application No. PCT/JP2009/006798, filed Dec. 11, 2009, whose priority is claimed on Japanese Patent Application No. 2008-319916, filed Dec. 16, 2008, the entire content of which are hereby incorporated by reference.

BACKGROUND OF THE INVENTION

1. Field of the Invention

The present invention relates to a connection structure of a coaxial harness. In particular, the present invention relates to a connection structure of a coaxial harness such that, when a plurality of coaxial harnesses, each comprising a plurality of micro coaxial cables, are connected to a substrate, a planar dimension of its connection part may be downsized.

2. Description of the Related Art

In recent years, electronic devices represented by portable phones have been rapidly downsized, become lesser in weight, and become multifunctional. According to such a trend in technology, it has become indispensable to downsize the wiring materials and terminal connectors used in electronic devices.

According to information equipment such as a cellular phone, a displaying part, comprising a liquid crystal panel and the like, and a main body part of the equipment are connected with a hinge part. Between the displaying part and the main body part of the equipment, it is necessary to provide a wiring structure which may be twisted.

As a wiring structure serving this purpose, a flexible printed circuit (hereinafter referred to as FPC) and a coaxial harness which is obtained by binding a plurality of coaxial cables and the like is known, compared to conventional structures.

Further, as the information equipment becomes smaller and smaller in size and becomes thinner and thinner, conservation of space and the reduction of radius are being carried out with respect to these wiring structures as well. Thus, a further conservation of space is being demanded.

A known connection structure for this coaxial harness is shown in FIGS. 5 to 7. According to this connection structure for this coaxial harness, each grand bar 21, 22, connected respectively to coaxial harnesses 1A, 1B stacked in a plurality of layers (two layers in the diagrammed example), is connected respectively to a plurality of ground bar connection terminal 17 (17A, 17B) provided on a substrate 15. FIG. 5 is a planar view of the substrate 15 used in this conventional connection structure of the coaxial harness. FIG. 6 is a cross sectional view of the conventional connection structure of the coaxial harness. FIG. 7 is a planar view of the conventional connection structure of the coaxial harness.

At a lower most portion of the substrate 15 used in the conventional connection structure of the coaxial harness, a first grand bar connection terminal 17A is provided as shown in FIG. 5. At an upper portion of this first grand bar connection terminal 17A, a first center conductor connection terminal group 19 is provided such that a plurality of center conductor connection terminal 18A are aligned in one line. Furthermore, a second ground bar connection terminal 17B is provided on the substrate 15, at an upper portion of this first center conductor connection terminal group 19. At an upper portion of this second ground bar connection terminal 17B, a second center conductor connection terminal group 20 is provided such that a plurality of center conductor connection terminal 18B are aligned in one line.

According to this conventional connection structure of the coaxial harness, an electric connection is made between the first ground bar 21 and the first ground bar connection terminal 17A. The first ground bar 21 is provided on the coaxial harness 1A in the first layer. The first ground bar connection terminal 17A is provided on the substrate 15. At the same time, an electric connection is made respectively between each center conductor 3A of the coaxial harness 1A in the first layer and the first center conductor connection terminal group 19. In addition, an electric connection is made between the second ground bar 22 and the second ground bar connection terminal 17B. The second ground bar 22 is provided on the coaxial harness 1B in the second layer. The second ground bar connection terminal 17B is provided on the substrate 15. At the same time, an electric connection is made respectively between each center conductor 3B of the coaxial harness 1B in the second layer and the second center conductor connection terminal group 20.

However, according to this structure, as the number of layers in the coaxial harness increases, there is also an increase in the proportion of the planar dimension of the connection part between the substrate and the coaxial harness on the substrate. As a result, it becomes difficult to reduce the size of the connection structure of this coaxial harness.

An example of a prior art technology aimed to reduce the size of the connection part of the connection structure of the coaxial harness is suggested and disclosed in Japanese Unexamined Patent Application, First Publication No. 2007-287541 (hereinafter referred to as Patent Document 1).

This Patent Document 1 discloses a cable harness. The cable harness comprises a connection terminal connected to each end terminal part of a plurality of coaxial cables. According to this cable harness, the connection terminal is structured by an FPC. This FPC comprises a bending part so that the FPC may be used while being bent. The connection part between the FPC and the coaxial cable is placed in both sides of the bending part of the FPC. The direction in which the FPC is bent at the bending part is a direction perpendicular to a longitudinal direction of the coaxial cable connected to the connection part.

However, according to the conventional technology disclosed in Patent Document 1, a special processing of this FPC is necessary in order to fold up the FPC. Furthermore, an extra procedure, such as wrapping a tape around the FPC, becomes necessary so that the FPC does not open up after being folded up. As a result, there is a problem in that the manufacturing cost of the cable harness disclosed in Patent Document 1 becomes high.

The present invention is made in light of these problems. An object of the present invention is to provide a connection structure such that, when a plurality of coaxial harnesses, comprising a plurality of coaxial cables, are connected to a substrate, a planar dimension of the connection part may be reduced and an increase in manufacturing costs is prevented. As a result of reducing the planar dimension of the connection part, a connection may be made with a greater number of coaxial cables.

SUMMARY

In order to resolve the above problems, the present invention employs the following measures.

(1) A connection structure of a coaxial harness according to the present invention includes a coaxial harness, a ground bar, and a substrate. The coaxial harness includes a plurality of coaxial cables lined up. The coaxial cable includes a center conductor, an inner insulator, an outer conductor, and a jacket. The inner insulator and the outer conductor and the jacket are placed at an outer side of the center conductor in an order of the inner insulator, the outer conductor, and the jacket. The ground bar sandwiches a plurality of the outer conductor exposed at an end terminal part of the coaxial harness. The substrate is provided with a ground bar connection terminal and a center conductor connection terminal group. The ground bar connection terminal is connected with the ground bar. The center conductor connection terminal group includes an alignment of a center conductor connection terminal connected respectively to the center conductor. Here, a plurality of the coaxial harnesses are stacked. In addition, a plurality of the center conductor connection terminal groups are provided to the substrate in a direction moving away from the ground bar connection terminal. The plurality of the center conductor connection terminal groups form a plurality of layers. Further, the ground bar is electrically connected to the one ground bar connection terminal. The ground bar is provided at an end terminal part of the plurality of coaxial harnesses. The center conductor of the coaxial harness, provided at a first layer close to the substrate, is connected to a first group of the center conductor connection terminal group, formed at a region closest to the ground bar connection terminal. Moreover, the center conductor of the coaxial harness, stacked on the coaxial harness provided at the first layer, is connected to the center conductor connection terminal group, provided at a next layer side with respect to the first group of the center conductor connection terminal group.

(2) The connection structure of the coaxial harness may be configured as follows: a wiring interval of the coaxial cable is equal between each of the coaxial harness.

(3) The connection structure of the coaxial harness may be configured as follows: a wiring interval of the coaxial cable is different between each of the coaxial harness.

(4) The connection structure of the coaxial harness may be configured as follows: a number of the coaxial cable is equal between the coaxial harness.

(5) The connection structure of the coaxial harness may be configured as follows: a number of the coaxial cable is different between the coaxial harness.

(6) The connection structure of the coaxial harness may be configured as follows: among the plurality of coaxial harnesses, at least one of the coaxial harnesses comprises a discrete line.

(7) The connection structure of the coaxial harness may be configured as follows: the ground bar collectively sandwiches from above and below, a plurality of the outer conductors of the coaxial harnesses forming a plurality of layers. Here, the plurality of the outer conductors are exposed. In addition, a solder is provided between the ground bars.

According to the connection structure of the coaxial harness described in (1) above, a ground bar is connected to an outer conductor of a coaxial harness being stacked in a plurality of layers. The ground bar is connected to a ground bar connection terminal, which is provided on a substrate. As a result, it is possible to reduce the planar dimension of a connection part, compared to an instance in which a ground bar of a coaxial harness stacked so as to form a plurality of layers is respectively connected individually for each layer to a ground bar connection terminal on a substrate. In addition, a special processing or procedure described in Patent Document 1 is not necessary. As a result, it is possible to prevent an increase in manufacturing costs.

EMBODIMENTS FOR CARRYING OUT THE INVENTION

Hereinafter, an embodiment of the present invention is described with reference to the diagrams.

Figure 1A:
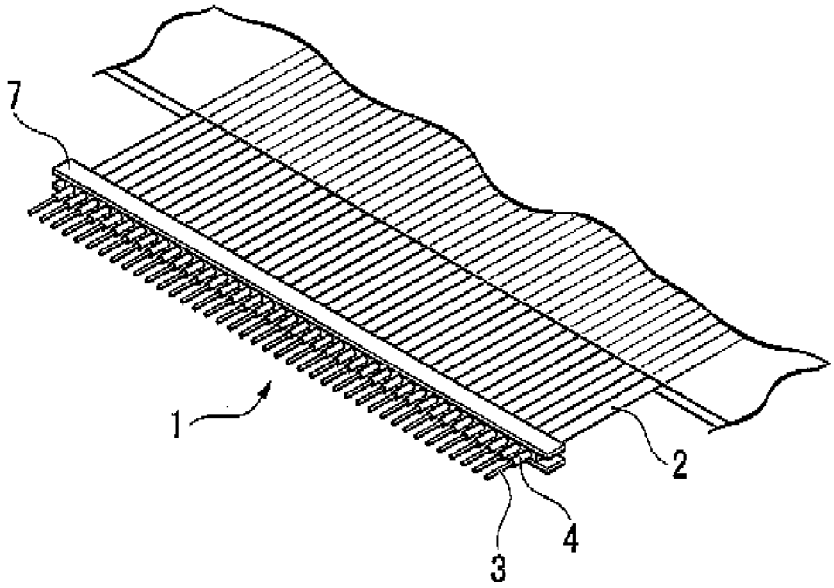
FIG. 1A is a perspective view showing an example of a coaxial cable connected with a ground bar used in a first embodiment of a connection structure of a coaxial harness according to the present invention.
Figure 1B:
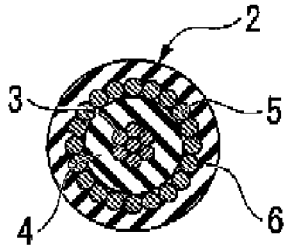
FIG. 1B is a cross sectional view of an micro coaxial cable used in a coaxial harness shown in FIG. 1A.
Figure 1C:
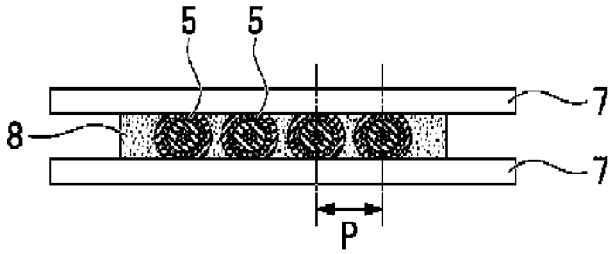
FIG. 1C is a cross sectional view of a connection part of a connection between a coaxial harness, shown in FIG. 1A, and a ground bar.

FIG. 1A is a perspective view showing an example of a coaxial harness used in a connection structure of a coaxial harness according to the present invention. FIG. 1B shows a cross sectional view when an micro coaxial cable is used as an example of a coaxial cable used in a connection structure of a coaxial harness according to the present invention. FIG. 1C is a cross sectional view of a portion of an outer conductor of an micro coaxial cable being sandwiched with a ground bar.

The coaxial harness 1 comprises a plurality of micro coaxial cables 2. The micro coaxial cable 2 comprises a center conductor 3 and an inner insulator 4, an outer conductor 5, and a jacket 6, which are provided in this order at an outer side of the center conductor 3. The plurality of micro coaxial cables 2 are aligned at equal intervals (a cable wiring interval shown in FIG. 1C with reference numeral P). The jacket 6 of one end part of the coaxial harness 1 is peeled off. As a result, the outer conductor 5 is exposed. This exposed outer conductor 5 is sandwiched from an upper side and a lower side with a pair of ground bars 7. The outer conductor 5 and the ground bar 7 are electrically connected by a solder 8 placed between these pair of ground bars 7. In addition, at a portion towards a tip side compared to the ground bar 7 of the coaxial harness 1, the inner insulator 4 is removed, and the center conductor 3 is exposed. FIG. 1A shows an example in which only one end part of the coaxial harness 1 is connected to the ground bar 7. A similar configuration may be made at a side of the other end part.

The present embodiment shows an example in which an micro coaxial cable 2 is used as a coaxial cable. However, the present invention is not limited only to the present example. A coaxial harness may be configured so that a plurality of coaxial cables with a variety of diameters are used, and that the coaxial harness comprises an arbitrary number of these coaxial cables.

According to the micro coaxial cable 2 used in the present embodiment, there is not particular limitation on the material and diameter of the center conductor 3 and the outer conductor 5. Neither is there a particular limitation on the type and thickness of the insulating material of the inner insulator 4 and the jacket 6. To give an example, according to a configuration of an micro coaxial cable which is used in general, a copper alloy and the like coated with tin or silver is used for the center conductor 3 and the outer conductor 5. The center conductor 3 is typically configured so that seven wires each having a radius of 0.030 mm are twisted together. Further, a fluoroplastic resin such as perfluoro alkyl vinyl ether (PFA) and the like are often used in the inner insulator 4 and the jacket 6.

This coaxial harness 1 is process in a condition such that a plurality of micro coaxial cables 2 are aligned at equal intervals. In other words, the semi-finished product having a structure shown in FIGS. 1A and 1C is manufactured by peeling off the jacket 6 at a terminal end part of a plurality of micro coaxial cables aligned at equal intervals; sandwiching an exposed portion of the outer conductor with a ground bar 7 from an upper side and a lower side; and by connecting the outer conductor 5 and the ground bar 7 with solder. Thereafter, and FPC and a connector and the like are connected to both ends of the coaxial harness 1. The cable wiring interval P of the micro coaxial cable 2 is generally set to approximately 0.3 to 0.5 mm.

The ground bar 7 is a conductive, elongated rod. The ground bar 7 comprises material which may be soldered.

Figure 2:
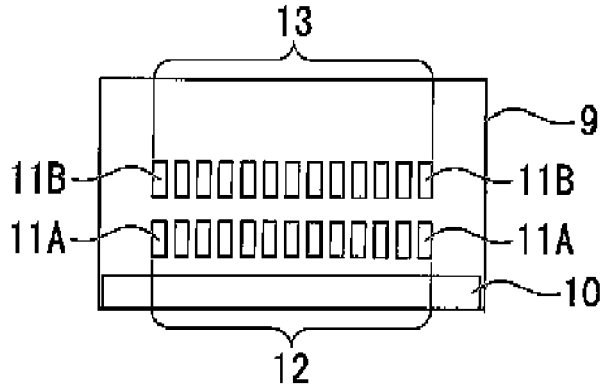
FIG. 2 is a planar view showing an example of a substrate used in the above embodiment.
Figure 3A:
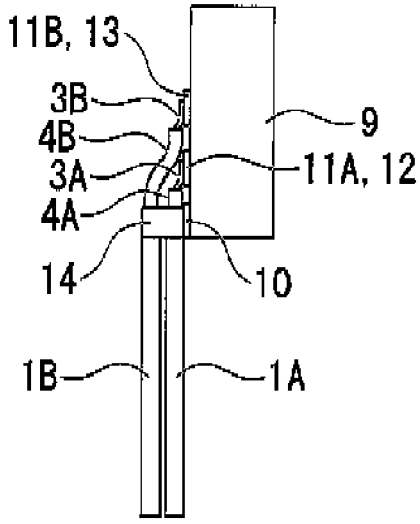
FIG. 3A is a cross sectional view showing the above embodiment.
Figure 3B:
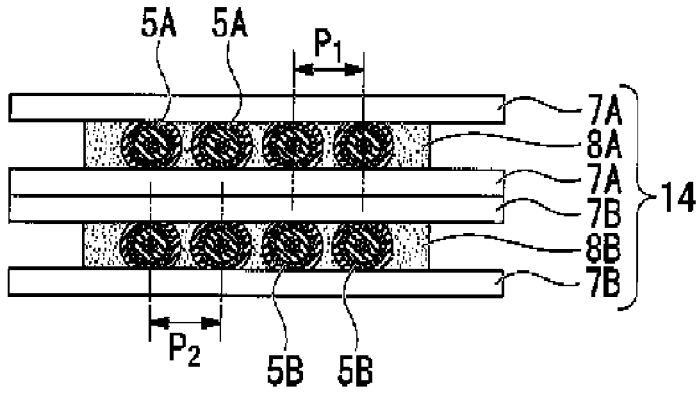
FIG. 3B is an example of a cross sectional view of a ground bar part according to the above embodiment.
Figure 3C:
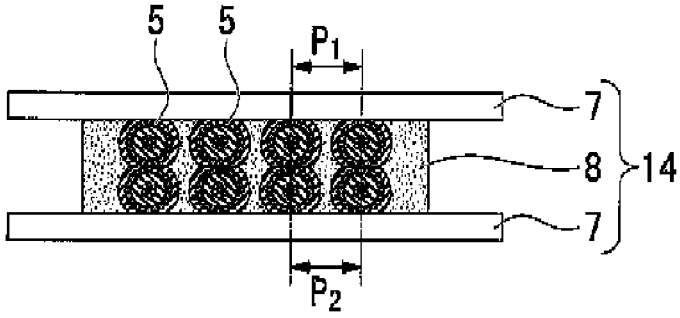
FIG. 3C is a cross sectional view showing a variation of a ground bar part according to the above embodiment.
Figure 3D:
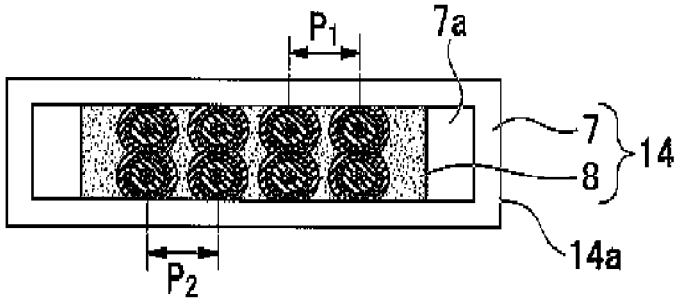
FIG. 3D is a cross sectional view showing another variation of a ground bar part according to the above embodiment.
Figure 4:
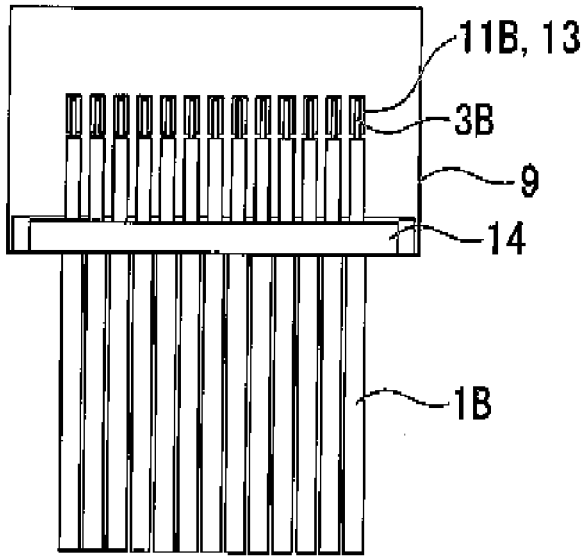
FIG. 4 is a planar view showing the above embodiment.

FIGS. 2 to 4 show an embodiment of a connection structure of a coaxial harness according to the present invention. FIG. 2 is a planar view of a substrate used in the present embodiment. FIG. 3A is a cross sectional view of a connection structure of a coaxial, harness according to the present embodiment. FIGS. 3B to 3D are cross sectional views of a ground bar portion according to the present embodiment. FIG. 4 is a planar view of a connection structure of a coaxial harness according to the present embodiment.

According to a connection structure of a coaxial harness based on the present embodiment, two coaxial harnesses 1A, 1B are stacked into two layers. The two coaxial harnesses 1A, 1B comprise a structure similar to a coaxial harness 1 shown in FIGS. 1A to 1C described earlier. The two coaxial harnesses 1A, 1B are connected to the substrate 9 (see FIG. 3A).

There is no particular limitation on the substrate 9. FPC is preferably used as the substrate 9. In addition, the present invention may also be applied to a rigid substrate.

One ground bar connection terminal 10 is provided on the substrate 9, as shown in FIG. 2. In addition, at an upper portion of the ground bar connection terminal 10 of the substrate 9, a center conductor connection terminal group 12 is provided. The center conductor connection terminal group 12 is configured so that a center conductor connection terminal 11A (11) is aligned. The center conductor connection terminal 11A is electrically connected with each center conductor 3A of the coaxial harness 1A. Furthermore, at an upper portion of the center conductor connection terminal group 12, a center conductor connection terminal group 13 is provided. The center conductor connection terminal group 13 is configured so that a center conductor connection terminal 11B (11) is aligned. The center conductor connection terminal 11B is electrically connected with each center conductor 33 of the coaxial harness 1B. In other words, the center conductor connection terminal group 12, 13 are provided on the substrate 9, forming two layers. Each of these center conductor connection terminals 11 (11A, 11B) is respectively electrically connected to a wiring part (not diagrammed) provided on the substrate 9.

According to the embodiment described above, an example was shown in which the center conductor connection terminals 11 (11A, 11B) are placed by being aligned in a reticular pattern. However, the alignment is not limited to a reticular pattern. These center conductor connection terminals 11 (11A, 11B) may be aligned in a staggered pattern. In this way, there is more freedom in the wiring pattern of the substrate 9.

As shown in FIG. 3B, a jacket 6 of an end part of the two-layered coaxial harnesses 1A, 1B is peeled off. In addition, the exposed outer conductor 5 (5A, 5B) of each layer is respectively sandwiched from its upper surface and lower surface with a pair of ground bars 7 (7A, 7B). A solder 8 (8A, 8B) is placed respectively between these ground bars 7 (7A, 7B). Each ground bar 7 (7A, 7B) and the outer conductor 5 (5A, 5B) are electrically connected. Since the ground bars 7 (7A, 7B) and the outer conductor 5 (5A, 5B) are stacked in layers and are electrically connected, the ground bars 7 (7A, 7B) and the outer conductor 5 (5A, 5B) operate as a shared ground bar 14 of the two-layered coaxial harness 1A, 1B. This shared ground bar 14 is soldered to a ground bar connection terminal 10 placed on the substrate 9.

As shown in FIG. 3C, the shared ground bar 14 may be configured so that the exposed outer conductor 5 (5A, 5B) in each layer of the two-layered coaxial harness 1A, 1B is collectively sandwiched by a pair of ground bars 7. A solder 8 is provided between these pair of ground bars 7. In this case, the number of ground bars 7 may be configured to be less than the case shown in FIG. 3B. As a result, the connection structure of the harness may be made thinner (lower in height).

In addition, the shared ground bar 14 described above may be configured so that, as shown in FIG. 3D, an exposed outer conductor 5 (5A, 5B) in each layer of the two-layered coaxial harness 1A, 1B is covered with a ground bar 7, a solder 8 is provided in a space 7*a* surrounded by this ground bar 7, and each ground bar 7 is electrically connected with the outer conductor 5 (5A, 5B). In this case, similar to FIG. 3C, the connection structure of the harness may be made thinner. Moreover, a connection with a terminal is made possible at a side surface 14*a* of the shared ground bar 14 in a direction in which the coaxial harness overlaps. The solder 8 may be provided so that each outer conductor 5 (5A, 5B) is electrically connected with the ground bar 7. It is not necessary that the solder 8 be placed in all areas of the space 7*a* surrounded by the ground bar 7.

A center conductor 3A (3) of a first-layered coaxial harness 1A closer to the substrate 9 is connected to a first center conductor connection terminal group 12. The first center conductor connection terminal group 12 is formed at a region close to the ground bar connection terminal 10 of the substrate 9. A center conductor 3B (3) of a second-layered coaxial harness 1B is connected with a second center conductor connection terminal group 13. The second-layered coaxial harness 1B is stacked on top of the first-layered coaxial harness 1A. The second center conductor connection terminal group 13 is formed at a region distanced from the ground bar connection terminal 10 compared to the first center conductor connection terminal group 12 of the substrate 9.

In this way, the center conductor 3B of the second-layered coaxial harness 1B connected to a terminal located farther compared to a center conductor 3A of the first-layered coaxial harness 1A. Therefore, second-layered coaxial harness 1B is configured so that the center conductor 3B and the inner insulator 4B exposed from the jacket 6 are longer than the center conductor 3A and the inner insulator 4A of the first-layered coaxial harness 1A. As a result, the center conductor 3B of the second-layered coaxial harness 1B is prevented from contacting the center conductor 3A of the first-layered coaxial harness 1A and the center conductor connection terminal 11A.

According to the embodiment described above, an example is shown in which the coaxial harnesses 1A and 1B are stacked together to form two layers. However, the coaxial harnesses may be stacked to form three or more layers. The ground bar connection terminal and a plurality of center conductor connection terminal groups may be provided not only at one surface of the substrate 9, but also at another surface in a similar manner. A multiple-layered coaxial harness may be connected to the ground bar connection terminal and the plurality of center conductor connection terminal groups.

In addition, the interval P1 and the number of the coaxial cable of the coaxial harness 1A may be equal to, or different from the interval P2 and the number of the coaxial cable of the coaxial harness 1B. Furthermore, at least one coaxial harness may comprise a discrete wire. As a result, a variety of coaxial harnesses may be connected to the same substrate 9, Thus, the present invention may be applied to a variety of equipments.

Figure 5:
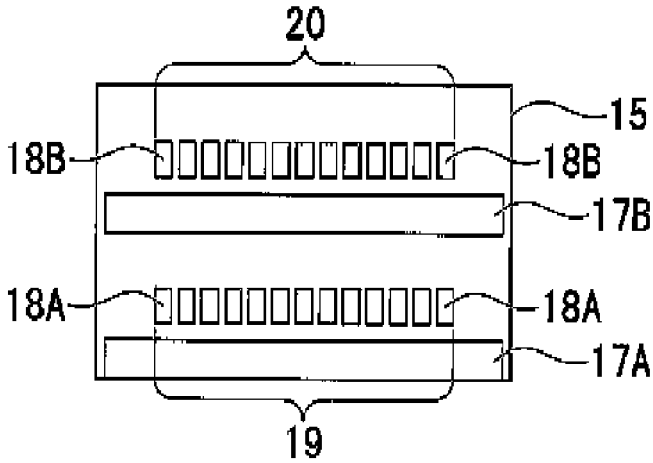
FIG. 5 is a planar view of a conventional substrate used in a connection structure of a coaxial harness.
Figure 6:
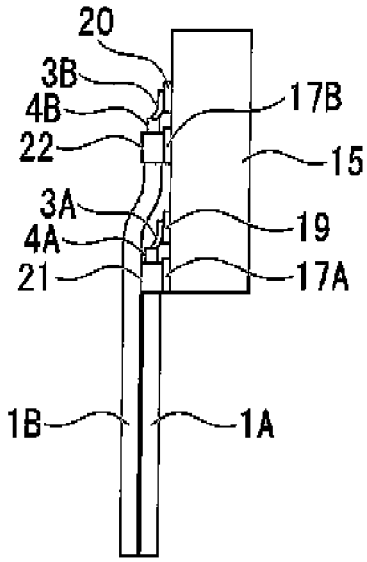
FIG. 6 is a cross sectional view of a conventional connection structure of a coaxial harness.
Figure 7:
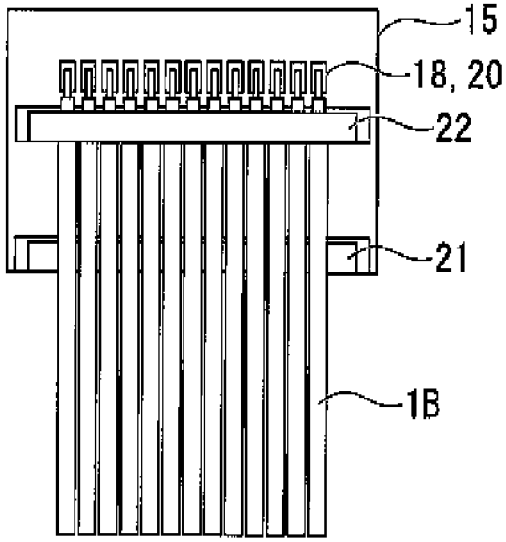
FIG. 7 is a planar view of a conventional connection structure of a coaxial harness.

Next, a comparison is made between a connection structure of a coaxial harness according to the present invention shown in FIGS. 2 to 4, and a conventional connection structure of a coaxial harness shown in FIGS. 5 to 7. According to a connection structure of a coaxial harness according to the present invention, a shared ground bar 14, connected to an outer conductor 5 (5A, 5B) of a two-layered coaxial harness 1A, 1B, is connected to a ground bar connection terminal 10 of a substrate 9. Therefore, according to a connection structure of a coaxial harness based on the present invention, a dimension of a connection part (a dimension from a ground bar connection terminal 10 to a second center conductor connection terminal group 13) may be reduced, compared to a conventional connection structure of a coaxial harness in which a ground bar 21, 22 in each layer of the coaxial harness 1A, 1B is connected individually to a ground bar connection terminal 17A, 17B in each layer of the substrate.

Next, a comparison is made between the present invention and a connection structure of a coaxial harness in which an FPC is bent. According to a connection structure of a coaxial harness based on the present invention, it is not necessary to perform a special processing folding up a substrate or a procedure in which a tape is wrapped around so that the substrate may be held while the substrate is folded up. Therefore, it is possible to prevent an increase in costs when the connection structure of the coaxial harness according to the present invention is manufactured. In addition, compared to a conventional configuration, it is possible to conserve space, because the same number of coaxial cables, which were used in a case in which the FPC was bent, may be connected at only one side of the substrate.

What is claimed is:

1. A connection structure of a coaxial harness comprising:

a coaxial harness comprising a plurality of coaxial cables lined up, the coaxial cable comprising a center conductor, an inner insulator placed at an outside of the center conductor, an outer conductor placed at an outside of the inner insulator, and a jacket placed at an outside of the outer conductor, a ground bar sandwiching a plurality of the outer conductor exposed at an end terminal part of the coaxial harness; and a substrate being provided with a ground bar connection terminal and a center conductor connection terminal group, the ground bar connection terminal being connected with the ground bar, and the center conductor connection terminal group comprising an alignment of a center conductor connection terminal connected respectively to the center conductor, wherein a plurality of the coaxial harnesses are stacked;

a plurality of the center conductor connection terminal groups are provided to the substrate in a direction moving away from the ground bar connection terminal, the plurality of the center conductor connection terminal groups forming a plurality of layers;

the ground bar being electrically connected to the one ground bar connection terminal, the ground bar being provided at an end terminal part of the plurality of coaxial harnesses;

the center conductor of the coaxial harness, provided at a first layer close to the substrate, is connected to a first group of the center conductor connection terminal group, formed at a region closest to the ground bar connection terminal, and, the center conductor of the coaxial harness, stacked on the coaxial harness provided at the first layer, is connected to the center conductor connection terminal group, provided at a next layer side with respect to the first group of the center conductor connection terminal group;

lengths of the center conductor and the inner insulator which are exposed at the end terminal part of a second coaxial harness are longer than those of a first coaxial harness, the second coaxial harness being stacked on the first coaxial harness; and by bending the center conductor and the inner insulator which are exposed at the end terminal part, the center conductor connects the center conductor connection terminal groups.

2. The connection structure of the coaxial harness according to claim 1, wherein a wiring interval of the coaxial cable is equal between each of the coaxial harness.

3. The connection structure of the coaxial harness according to claim 1, wherein a wiring interval of the coaxial cable is different between each of the coaxial harness.

4. The connection structure of the coaxial harness according to claim 1, wherein a number of the coaxial cable is equal between the coaxial harness.

5. The connection structure of the coaxial harness according to claim 1, wherein a number of the coaxial cable is different between the coaxial harness.

6. The connection structure of the coaxial harness according to claim 1, wherein, among the plurality of coaxial harnesses, at least one of the coaxial harnesses comprises a discrete line.

7. The connection structure of the coaxial harness according to claim 1, wherein the ground bar collectively sandwiches from above and below, a plurality of the outer conductors of the coaxial harnesses forming a plurality of layers, the plurality of the outer conductors being exposed; and a solder is provided between the ground bars.

8. The connection structure of the coaxial harness according to claim 1, wherein the ground bar covers the a plurality of the outer conductors of the coaxial harnesses forming a plurality of layers, the plurality of the outer conductors being exposed.

9. A connection structure of a coaxial harness comprising:

a coaxial harness comprising a plurality of coaxial cables lined up, the coaxial cable comprising a center conductor, an inner insulator placed at an outside of the center conductor, an outer conductor placed at an outside of the inner insulator, and a jacket placed at an outside of the outer conductor;

a ground bar sandwiching a plurality of the outer conductor exposed at an end terminal part of the coaxial harness; and a substrate being provided with a ground bar connection terminal and a center conductor connection terminal group, the ground bar connection terminal being connected with the ground bar, and the center conductor connection terminal group comprising an alignment of a center conductor connection terminal connected respectively to the center conductor, wherein a plurality of the coaxial harnesses are stacked;

a plurality of the center conductor connection terminal groups are provided to the substrate in a direction moving away from the ground bar connection terminal, the plurality of the center conductor connection terminal groups forming a plurality of layers;

the ground bar being electrically connected to the one ground bar connection terminal, the ground bar being provided at an end terminal part of the plurality of coaxial harnesses;

the center conductor of the coaxial harness, provided at a first layer close to the substrate, is connected to a first group of the center conductor connection terminal group, formed at a region closest to the ground bar connection terminal, and the center conductor of the coaxial harness, stacked on the coaxial harness provided at the first layer, is connected to the center conductor connection terminal group, provided at a next layer side with respect to the first group of the center conductor connection terminal group;

the ground bar collectively sandwiches from above and below, a plurality of the outer conductors of the coaxial harnesses forming a plurality of layers, the plurality of the outer conductors being exposed; and a solder is provided between the ground bars.

* * * * *